US008342523B2

(12) United States Patent
Ishida

(10) Patent No.: US 8,342,523 B2
(45) Date of Patent: Jan. 1, 2013

(54) IMAGE FORMING APPARATUS WITH INDERMEDIATE GEAR

(75) Inventor: Kei Ishida, Nishi-ku (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/249,837

(22) Filed: Sep. 30, 2011

(65) Prior Publication Data

US 2012/0068403 A1 Mar. 22, 2012

Related U.S. Application Data

(62) Division of application No. 12/549,886, filed on Aug. 28, 2009, now Pat. No. 8,113,507.

(30) Foreign Application Priority Data

Aug. 29, 2008 (JP) ..... 2008-221999
Aug. 29, 2008 (JP) ..... 2008-222008

(51) Int. Cl.
*B65H 5/06* (2006.01)

(52) U.S. Cl. ..... 271/272; 271/188; 271/209

(58) Field of Classification Search ..... 271/188, 271/209, 272–274; 399/406, 124
See application file for complete search history.

(56) References Cited

U.S. PATENT DOCUMENTS 2,961,947 A * 11/1960 Springer ..... 271/274
3,246,822 A * 4/1966 Skeen ..... 271/273
3,743,406 A * 7/1973 Komori et al. ..... 271/273
5,484,140 A * 1/1996 Hirose et al. ..... 271/274
5,771,057 A 6/1998 Rombult et al.
5,983,062 A 11/1999 Sameshima
6,240,260 B1 5/2001 Krupica et al.
7,984,907 B2 * 7/2011 Chen ..... 271/273
2006/0216060 A1 * 9/2006 Kuwata et al. ..... 399/124
2007/0018385 A1 * 1/2007 Park ..... 271/272

FOREIGN PATENT DOCUMENTS

JP 62-147467 A 7/1987
JP 01-105277 4/1989
JP 01-115660 8/1989
JP 02-243438 9/1990

(Continued)

OTHER PUBLICATIONS

Notification of Reasons for Refusal for corresponding Japanese Patent Application 2008-221999 mailed Nov. 29, 2011.
Decision of Grant for Patent issued in counterpart Japanese Patent Application No. 2008-222008 dated Aug. 21, 2012.

*Primary Examiner* — Gerald McClain
(74) *Attorney, Agent, or Firm* — Banner & Witcoff, Ltd.

(57) ABSTRACT

A pair of conveyor rollers arranged in an image forming apparatus to convey a recording sheet is configured to be shiftable relative to the body between a first position and a second position. A first holding member is configured to support one of the conveyor rollers so that the supported conveyor roller is swingable around a pivot to allow the pair of conveyor rollers to be shifted between the first position and the second position. The first holding member including a sheet guide portion which provides a variable-position guide-way extending from a position located upstream along the sheet conveyance path toward a peripheral surface of the supported conveyor roller, where the sheet guide portion moves to a position suitable to guide the recording sheet to be nipped by the pair of conveyor rollers at least when the pair of conveyor rollers is shifted to the first position.

6 Claims, 10 Drawing Sheets

FOREIGN PATENT DOCUMENTS

| | | |
|---|---|---|
| JP | 03-088667 | 4/1991 |
| JP | 04-063387 | 2/1992 |
| JP | 05-058527 | 3/1993 |
| JP | 07-048046 | 2/1995 |
| JP | 08-160787 A | 6/1996 |
| JP | 11-030896 | 2/1999 |
| JP | 2000-310902 | 11/2000 |
| JP | 2001-341909 | 12/2001 |
| JP | 2002-274727 A | 9/2002 |
| JP | 2007-297198 | 11/2007 |

* cited by examiner

IMAGE FORMING APPARATUS WITH INDERMEDIATE GEAR

CROSS-REFERENCE TO RELATED APPLICATION(S)

This application is a divisional of co-pending U.S. application Ser. No. 12/549,886, filed Aug. 28, 2009, which claims the foreign priority benefit under Title 35, United States Code, §119 (a)-(d), of Japanese Patent Application Nos. 2008-221999 and 2008-222008, filed on Aug. 29, 2008 in the Japan Patent Office, the disclosures of which are herein incorporated by reference in its entirety.

BACKGROUND OF THE INVENTION

1. Field of the Invention

The present invention relates to an image forming apparatus such as a laser printer.

2. Description of Related Art

In an image forming apparatus such as a laser printer, generally, a developer image transferred onto a sheet (e.g., of paper) is thermally fixed thereon in a fixing device. It is known that a sheet subjected to this fixing process tends to curl (curve) due to several factors such as application of mechanical force, evaporation of moisture by heat, and shrinkage of developer. Since the sheet thus curled and then ejected could not be stacked neatly on a sheet output tray, an improved image forming apparatus has been proposed in which after the fixing process a sheet is passed through between conveyor rollers provided in a pair so that a mechanical force is applied to the sheet to reduce an amount of curl thereof.

However, the amount and direction of curl of a sheet may vary with the material and thickness of the sheet, and thus the reduction of the amount of curl could be insufficient or the amount of curl could rather become greater, as the case may be, depending upon the type of the sheet used. With this in view, JP 7-048046 A (see FIG. 1) proposes an image forming apparatus in which a pair of conveyor rollers is swung upward or downward and shifted in position in accordance with an expected amount of curl which may vary with the material and thickness of the sheet so that a substantial reduction of the amount of curl can be ensured.

In the apparatus where a pair of conveyor rollers can be shifted in position, a nip position at which the conveyor rollers nip a sheet is shifted as well, and thus a sheet conveyance path is changed accordingly. When the sheet conveyance path is changed, the sheet would possibly fail to be conveyed smoothly to the nip position of the conveyor rollers, and the sheet could strike a conveyor roller or a guide rib and become jammed at worst.

The present invention has been made in an attempt to eliminate the aforementioned disadvantages in prior art.

SUMMARY OF THE INVENTION

It is one aspect of the present invention to provide an image forming apparatus having a pair of conveyor rollers configured to be shiftable, wherein a sheet is smoothly conveyed to a nip position at which the conveyor rollers will nip the sheet. With this feature, a paper (sheet) jam can be prevented from occurring.

In an exemplary configuration where a conveyor roller (i.e., one of the conveyor rollers provided in pair) to which a conveyor roller gear is fixed such that it is rotatable integrally with the conveyor roller is configured to be rectilinearly movable or slidable along a straight line, there is a need to provide a power transmission mechanism which ensures that a driving force is transmitted to the conveyor roller gear because the conveyor roller gear is also shifted in position together with conveyor roller when the conveyor roller is slid so that a pair of the conveyor rollers is shifted in position.

Thus, it is another aspect of the present invention to provide an image forming apparatus having a pair of conveyor rollers configured to be shiftable, wherein a driving force can be transmitted to a conveyor roller gear which is rotatable integrally with one of the conveyor rollers.

More specifically, according to a first embodiment of the present invention, an image forming apparatus in which a developer image is transferred onto a recording sheet and fixed thereon comprises a body, a pair of conveyor rollers and a first holding member. The pair of conveyor rollers is arranged to convey a recording sheet which has been subjected to a fixing process toward outside of the body. The pair of conveyor rollers is configured to be shiftable relative to the body between a first position and a second position. The first holding member is configured to support one of the conveyor rollers in such a manner that a conveyor roller supported by the first holding member is swingable around a pivot located adjacent to a sheet conveyance path upstream of the supported conveyor roller to allow the pair of conveyor rollers to be shifted between the first position and the second position. The first holding member comprises a sheet guide portion which provides a variable-position guideway extending from a position located upstream along the sheet conveyance path toward a peripheral surface of the supported conveyor roller. The sheet guide portion is configured to guide the recording sheet toward a nip position at which the pair of conveyor rollers nips the recording sheet at least when the pair of conveyor rollers is shifted to the first position.

With this image forming apparatus configured as described above, when the pair of conveyor rollers is in the first position, conveyance of a recording sheet which has been subjected to the fixing process is guided by the sheet guide portion. Since the sheet guide portion provides a variable-position guideway extending from a position located upstream along the sheet conveyance path toward the peripheral surface of the conveyor roller supported by the first holding member, the recording sheet can be conveyed smoothly toward the nip position at which the pair of conveyor rollers nips the recording sheet. To be more specific, for example, a guide (e.g., a plurality of guide ribs) configured to guide the recording sheet toward the nip position at least when the pair of conveyor rollers is in the second position may be provided in (the body of) the image forming apparatus. In this configuration, the sheet guide portion of the first holding member may be configured to protrude from the guide when the pair of conveyor rollers is shifted to the first position, so that the recording sheet can be conveyed smoothly toward the nip position.

According to a second embodiment of the present invention, an image forming apparatus in which a developer image is transferred onto a recording sheet and fixed thereon comprises a body, a pair of conveyor rollers, a conveyor roller gear, a driving gear, an intermediate gear, a gear holding member, and a gear pressure element. The pair of conveyor rollers is, as in the first embodiment described above, arranged to convey the recording sheet which has been subjected to a fixing process toward outside of the body, and configured to be shiftable relative to the body between a first position and a second position. The conveyor roller gear is fixed to one of the conveyor rollers and configured to rotate integrally with the one of the conveyor rollers. The one of the conveyor rollers is supported in a manner that allows the one of the conveyor rollers as well as the conveyor roller gear to be moved rectilinearly when viewed from an axial direction of the one of the conveyor rollers to shift the pair of conveyor rollers between the first position and the second position. The driving gear is configured to receive a rotatory driving force. The intermediate gear is configured to mesh with the conveyor roller gear and the driving gear, to transmit the rotatory driving force received by the driving gear to the conveyor roller gear. The gear holding member is configured to hold the intermediate gear and one of the conveyor roller gear and the driving gear in a manner that allows the intermediate gear to swing around an axis of rotation of the one of the conveyor roller gear and the driving gear. The gear pressure element is configured to press the intermediate gear to the other of the conveyor roller gear and the driving gear which is not held by the gear holding member.

With this image forming apparatus configured as described above, the intermediate gear, as well as the conveyor roller gear (or the driving gear), is held by the gear holding member in such a manner that the intermediate gear is swingable around the axis of rotation of the conveyor roller gear (or the driving gear), and is pressed by the gear pressure element to the driving gear (or the conveyor roller gear). This configuration ensures that the intermediate gear always meshes with the conveyor roller gear and the driving gear to transmit a driving force from the driving gear through the intermediate gear to the conveyor roller gear without fail, even when the conveyor roller gear is shifted.

BRIEF DESCRIPTION OF THE DRAWINGS

The above aspects, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

Figure 1:
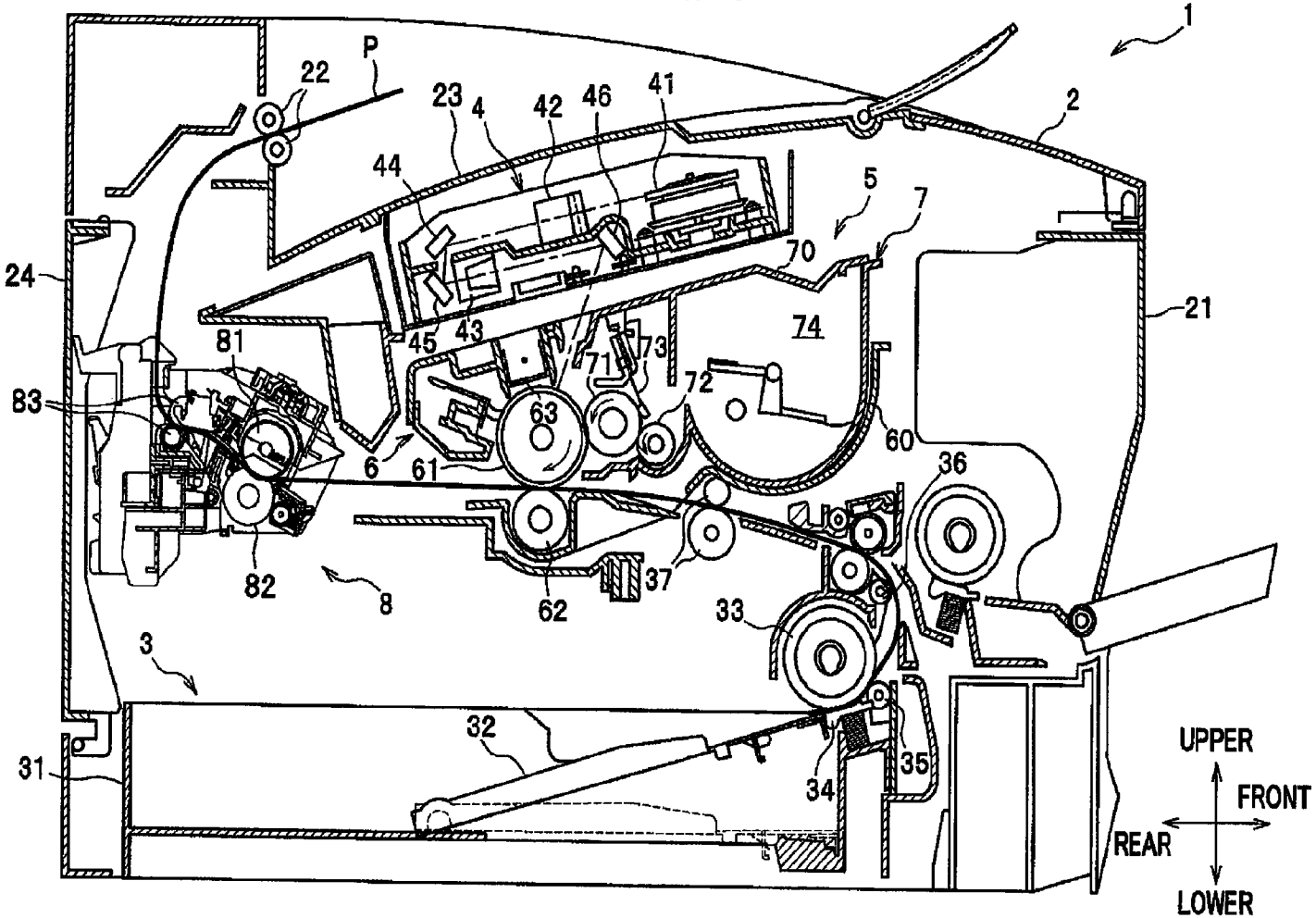
FIG. 1 is a vertical section of a laser printer as an example of an image forming apparatus according to an exemplary embodiment of the present invention.

A detailed description will be given of exemplary embodiments of the present invention with reference to the drawings. In the following description, the direction is designated as from the viewpoint of a user who is using (operating) a laser printer (image-forming apparatus). To be more specific, in FIG. 1, the right-hand side of the drawing sheet corresponds to the "front" side of the printer, the left-hand side of the drawing sheet corresponds to the "rear" side of the printer, the back side of the drawing sheet corresponds to the "right" side of the printer, and the front side of the drawing sheet corresponds to the "left" side of the printer. Similarly, the direction of a line extending from top to bottom of the drawing sheet corresponds to the "vertical" or "up/down (upper/lower or top/bottom)" direction of the printer.

General Setup of Laser Printer

At the outset, a general setup of a laser printer as an example of an image-forming apparatus according to an exemplary embodiment of the present invention will be described with reference to FIG. 1.

As shown in FIG. 1, a laser printer 1 comprises a body casing 2, and other components housed within the body casing 2 which principally include a sheet feeder unit 3 for feeding a sheet P (e.g., of paper) as a recording sheet, an exposure device 4, a process cartridge 5 for transferring a toner image (developer image) onto a sheet P, and a fixing device 8 for thermally fixing the toner image on the sheet P.

The sheet feeder unit 3 is provided in a lower space within the body casing 2, and includes: a sheet feed tray 31 removably installed in the body casing 2; and a sheet pressure plate 32 provided at a bottom of the sheet feed tray 31 and configured to be tiltable (swingable on a pivot) so as to allow its front side (i.e., of the sheet feed tray 31) to be lifted up. The sheet feeder unit 3 also includes a sheet feed roller 33, a sheet feed pad 34, paper powder remover rollers 35, 36 and a registration roller 37, all of which are disposed above a front side of the sheet feed tray 31.

In the sheet feeder unit 3, sheets P in the sheet feed tray 31 are lifted by the sheet pressure plate 32 and moved to a sheet feed roller 33 side. The sheets P are then separated and fed one after another by the sheet feed roller 33 and the sheet feed pad 34; each sheet P thus passes the paper powder remover rollers 35, 36 and the registration roller 37, and is conveyed to the process cartridge 5.

The exposure device 4 is provided in an upper space within the body casing 2, and includes a laser beam emitter (not shown), a polygon mirror 41 configured to be driven to spin, lenses 42, 43, reflecting mirrors 44, 45, 46 and other components. A laser beam formed in accordance with image data and emitted from the laser beam emitter is transmitted or reflected by the polygon mirror 41, lens 42, reflecting mirror 44, 45, lens 43, and reflecting mirror 46 in this sequence as indicated by alternate long and short dashed lines, so as to scan a peripheral surface of a photoconductor drum 61 in the process cartridge 5 at high speed.

The process cartridge 5 is disposed below the exposure device 4 and removably installed in the body casing 2. The body casing 2 has an opening formed at a front side thereof and is configured to allow the process cartridge 5 to be installed into and removed from the body casing 2 through the opening when a front cover 21 thereof provided to close the opening is opened. The process cartridge 5 comprises a drum cartridge 6 and a development cartridge 7.

The drum cartridge 6 comprises a hollow drum case 60 making up the outer frame of the process cartridge 5, and other components housed within the drum case 60 which principally include a photoconductor drum 61, a transfer roller 62 and a charger 63. The photoconductor drum 61 and the transfer roller 62 are rotatably supported at the drum case 60.

The development cartridge 7 is configured to be detachably attached to the drum cartridge 6 (drum case 60). The development cartridge 7 comprises a development case 70, and other components housed within the development case 70 which principally include a development roller 71, a supply roller 72 and a doctor blade 73. The development roller 71 and the supply roller 72 are rotatably supported at the development case 70. A toner reservoir 74 is formed in the development case 70.

In the process cartridge 5, the photoconductive surface of the photoconductor drum 61 is positively charged uniformly by the charger 63, and then exposed to a rapidly scanning laser beam directed from the exposure device 4. This exposure process lowers the potential of an exposed area(s) on the photoconductive surface, thus forming an electrostatic latent image thereon based upon the image data.

In the meantime, toner (now shown) in the toner reservoir 74 is supplied to the supply roller 72, and then supplied onto the development roller 71 as the supply roller 72 and the development roller 71 slidably in contact with each other rotate. The toner supplied onto the development roller 71 goes between the development roller 71 and the doctor blade 73 as the development roller 71 rotates, to form a thin film of a predetermined thickness, so that the thin film of toner is retained on the development roller 71.

The toner retained on the development roller 71 is supplied onto the photoconductor drum 61 and transferred to the areas corresponding to the electrostatic latent image formed thereon, as the development roller 71 and the photoconductor drum 61 disposed opposite to each other rotate so that the toner-carrying areas on the development roller 71 come in contact with the photoconductor drum 61. The toner retained selectively, i.e., solely in the areas corresponding to the electrostatic latent image, thus visualizes the latent image, to form a toner image on the photoconductor drum 61. As a sheet P is held and fed forward between the photoconductor drum 61 and the transfer roller 62, the toner image on the photoconductor drum 61 is transferred to the sheet P.

The fixing device 8 is provided rearwardly of the process cartridge 5 (downstream relative to the process cartridge 5 in a sheet conveyance direction), and principally includes a heating roller 81, a pressure roller 82, and a conveyor roller assembly 83. The pressure roller 82 is disposed opposite to the heating roller 81, so that a sheet P can be pinched between the heating roller 81 and the pressure roller 82. The conveyor roller assembly 83 consists essentially of a pair of conveyor rollers configured to convey a sheet P which has been subjected to a fixing process toward outside of the body casing 2. The structure of the fixing device 8 (particularly, a conveyor roller assembly 83 or a pair of conveyor rollers, and its associated constructions) will be described later in more detail.

The toner image transferred on a sheet P is thermally fixed while the sheet P passes through between the heating roller 81 and the pressure roller 82. The sheet P on which a toner image is thermally fixed is conveyed by the conveyor roller assembly 83 and ejected out of the body casing 2 by a pair of sheet output rollers 22, so that sheets P are stacked and accumulated on a sheet output tray 23 formed on an upper side of the body casing 2.

Structure of Conveyor Roller Assembly

Referring now to FIGS. 2 through 8, a detailed structure of the fixing device 8 (the conveyor roller assembly 83 and its associated construction) will now be described.

Figure 3A:
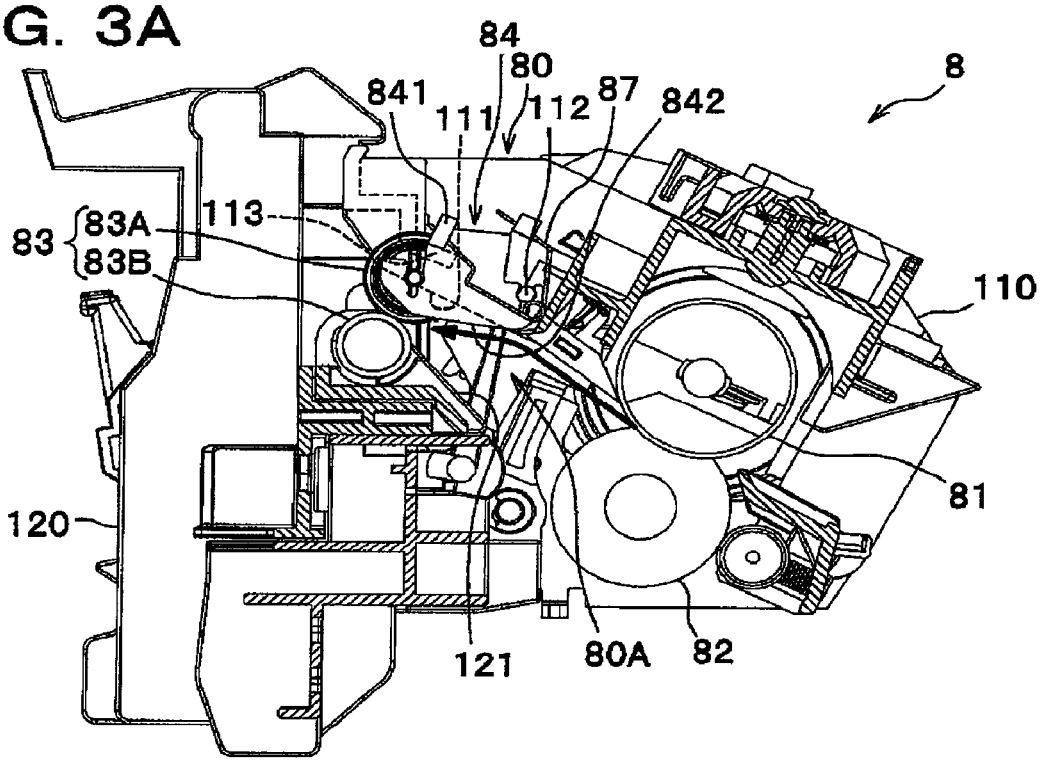
FIG. 3A is a vertical section of the fixing device in which conveyor rollers are in a lower position.
Figure 3B:
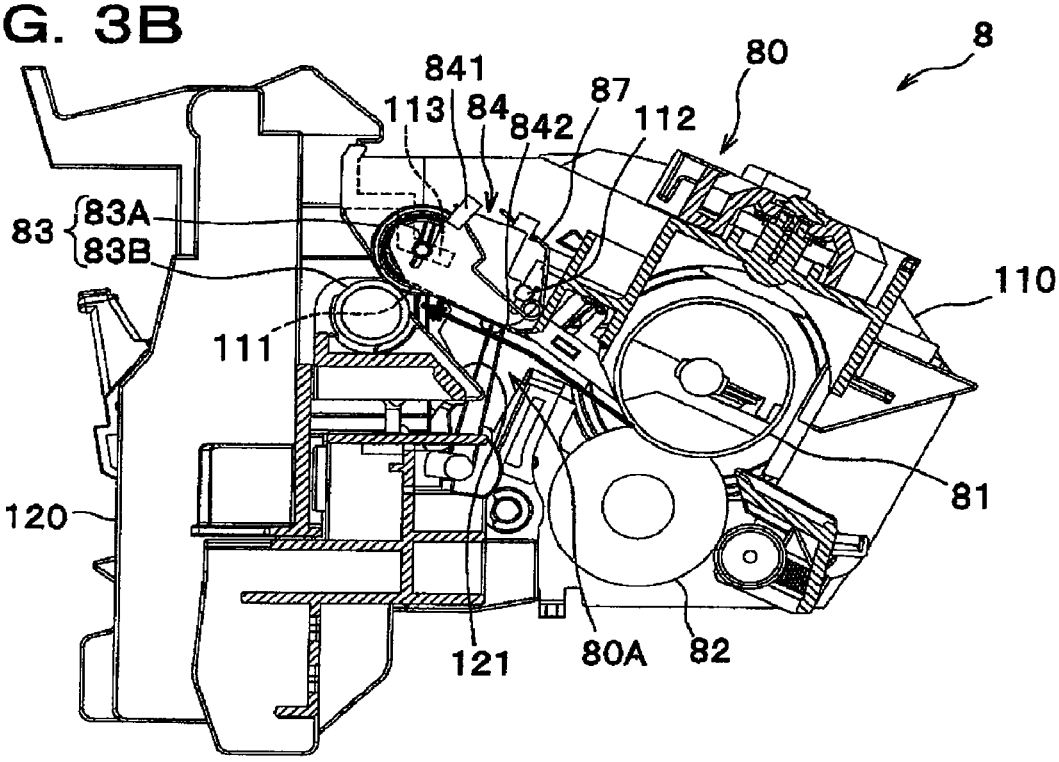
FIG. 3B is a vertical section of the fixing device in which the conveyor rollers are in an upper position.
Figure 5A:
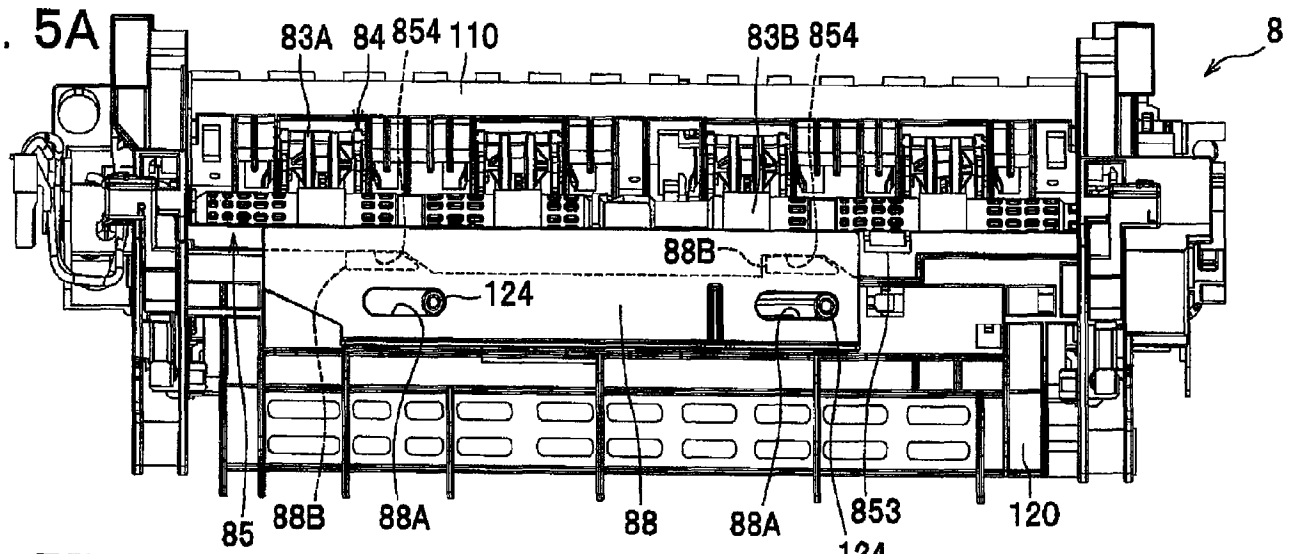
FIG. 5A is a rear view of the fixing device in which the conveyor rollers are in the lower position.
Figure 5B:
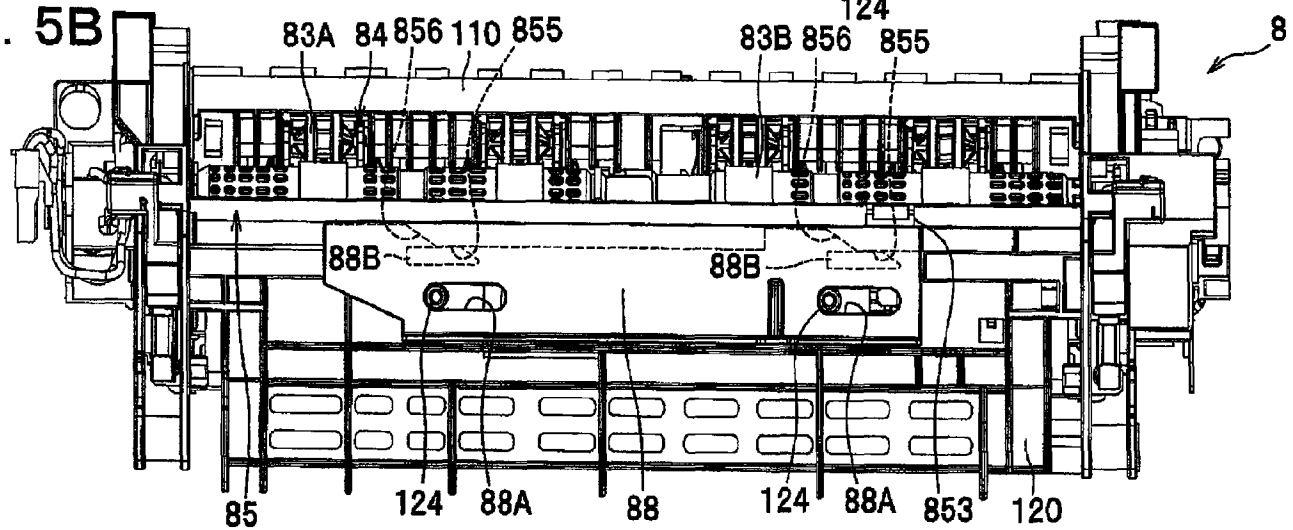
FIG. 5B is a rear view of the fixing device in which the conveyor rollers are in the upper position.
Figure 7A:
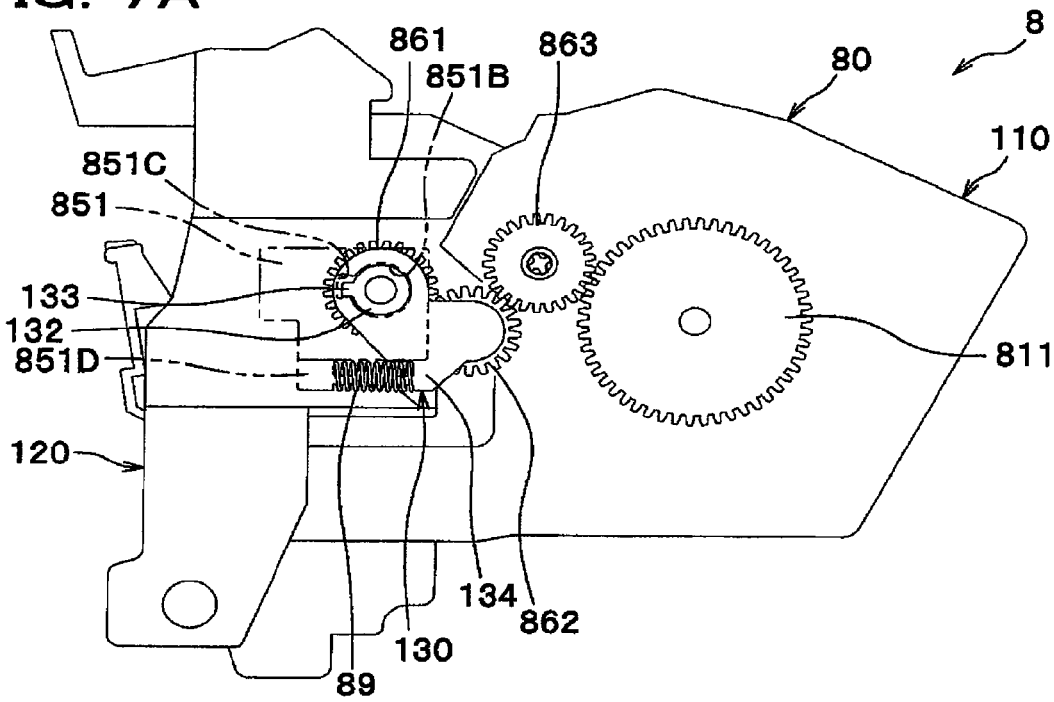
FIG. 7A is a schematic diagram of the fixing device in which a conveyor roller gear is in a lower position.
Figure 7B:
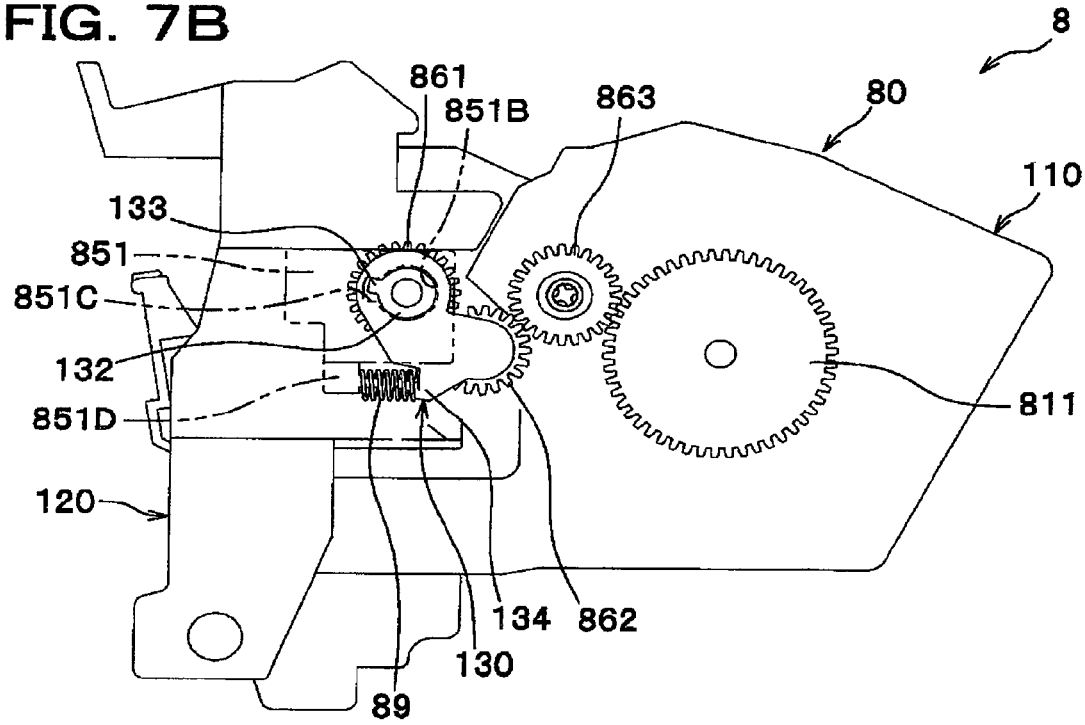
FIG. 7B is a schematic diagram of the fixing device in which a conveyor roller gear is in an upper position.

In describing the present embodiment, the position of the conveyor roller assembly 83 as shown in FIGS. 3A, 5A and 7A (in which the conveyor roller assembly 83 is in a lower position) will be referred to as "first position", and the position of the conveyor roller assembly 83 as shown in FIGS. 3B, 5B and 7B (in which the conveyor roller assembly 83 is in an upper position) will be referred to as "second position". When the upper and lower positions are mentioned in reference to the position of the conveyor roller assembly 83, the designated position can be considered as upper and lower limit positions of a nip position thereof at which a pair of conveyor rollers 83A and 83B nips a recording sheet P. Therefore, the assembly 83 of conveyor rollers 83A and 83B in the upper position is not necessarily disposed entirely above the assembly 83 in the lower position, and the assembly 83 in the lower position is not necessarily disposed entirely below the assembly 83 in the upper position. In this context, the present embodiment illustrates an exemplary configuration in which the nip position of the conveyor roller assembly 83 located in the first position is below the nip position of the conveyor roller assembly 83 located in the second position.

Figure 2:
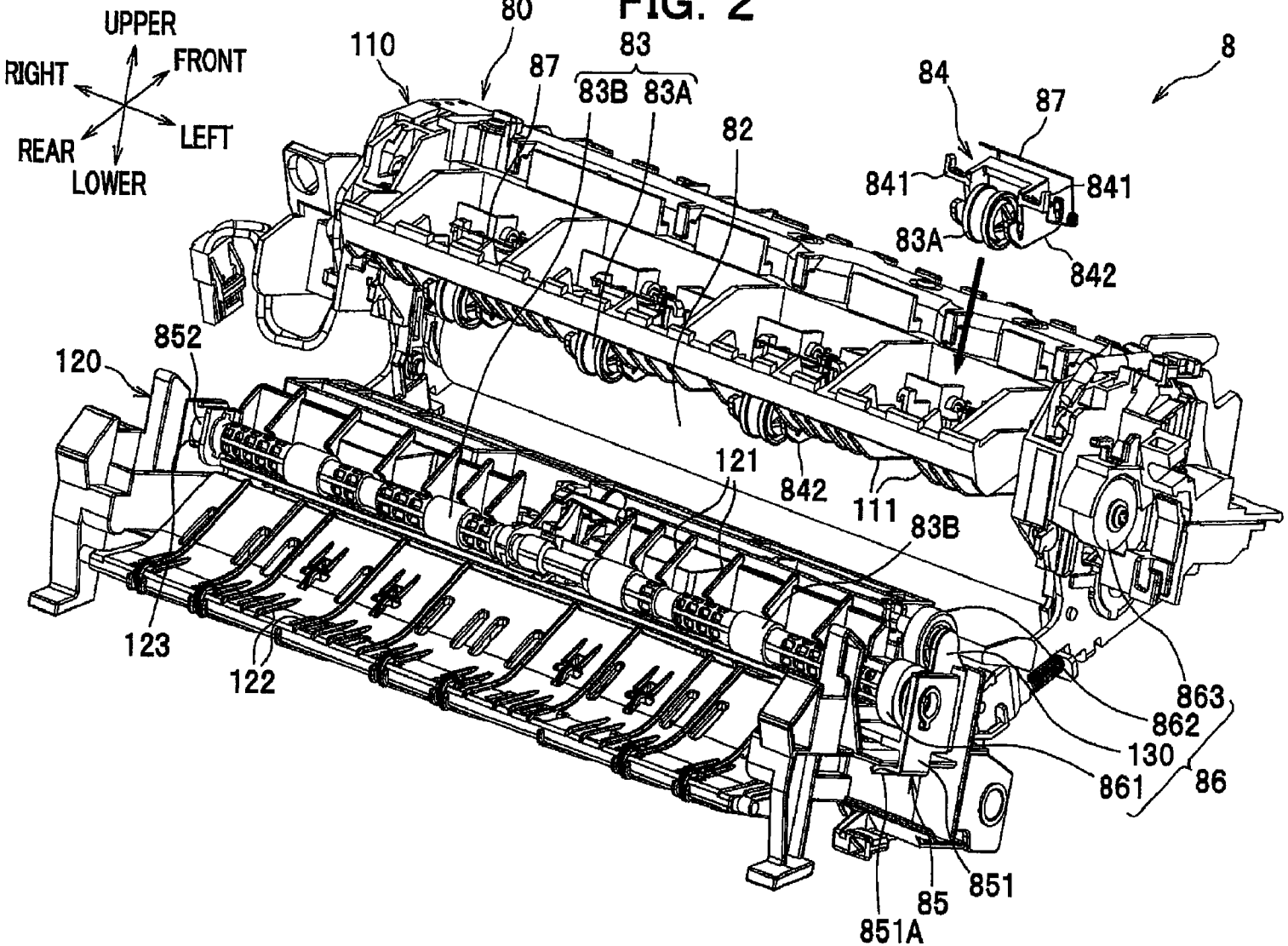
FIG. 2 is a perspective view of a fixing device with a swingable portion swung open from an immovable portion to expose a sheet conveyance path.

As shown in FIG. 2, the fixing device 8 comprises a fixing device case 80, and other components housed within the fixing device case 80 which principally include a heating roller 81 (see FIG. 1), a pressure roller 82, a conveyor roller assembly 83 (a plurality of pairs of conveyor rollers 83A, 83B), a first holder 84 as one example of a first holding member, a second holder 85 as one example of a second holding member, and a gear mechanism 86 configured to transmit a driving force to the conveyor roller assembly 83. To clearly illustrate the structure of each component, FIG. 2 shows an interior of the fixing device 8 with a sheet conveyance path 80A being exposed. The sheet conveyance path 80A will be described later.

Each pair of conveyor rollers 83A, 83B which makes up the conveyor roller assembly 83 consists essentially of an upper roller 83A and a lower roller 83B disposed below the upper roller 83A. The fixing device 8 in this embodiment comprises a plurality of (four) pairs of rollers arranged transversely (along a width of the recording sheet P as conveyed).

The fixing device case 80 principally includes an immovable portion 110 and a swingable portion 120. The immovable portion 110 is fixed to the body casing 2 and constitutes a part of the body of the apparatus. The swingable portion 120 is one example of a roller holding member configured to support one of conveyor rollers.

In this embodiment, the immovable portion 110 is configured to support the upper roller 83A through the first holder 84, and the swingable portion 120 is configured to support the lower roller 83B through the second holder 85.

The swingable portion 120 can be swung relative to the immovable portion 110 (i.e., the body of the apparatus) by manipulating the swingable portion 120 through an opening which is to be formed when a rear cover 24 (see FIG. 1) provided at a rear side of the body casing 2 is opened.

When the swingable portion 120 is swung from the position shown in FIG. 2 to cause the lower roller 83B and the upper roller 83A to nip, (i.e., when the swingable portion 120 is closed, like a lid or a cover), a gap between opposed sides of the immovable portion 110 and the swingable portion 120 constitutes the sheet conveyance path 80A along which a sheet P having been subjected to the fixing process is conveyed toward outside of the body casing 2 (see FIGS. 3A and 3B). To be more specific, a principal portion of a guide which defines the sheet conveyance path 80A to guide the conveyance of a sheet P is composed of a plurality of guide ribs 111 provided on the immovable portion 110 and a plurality of guide ribs 121, 122 provided on the swingable portion 120. Each guide rib 111, 121, 122 is designed to extend generally along a direction in which the sheet P is to be conveyed.

In the present embodiment, the sheet conveyance path 80A (guide ribs 111, 121, 122) can be exposed to the outside by swinging the swingable portion 120 from the position shown in FIG. 3A to the position shown in FIG. 2. By doing so, a sheet P if jammed in the sheet conveyance path 80A can easily be removed therefrom.

As shown in FIGS. 2, 3A and 3B, the first holder 84 in the present embodiment comprises a plurality of individual holders each provided for a corresponding pair of conveyor rollers 83A, 83B (each of the upper roller 83A) of the conveyor roller assembly 83. The first holder 84 is configured to support the upper rollers 83A (ones of the paired conveyor rollers) in a manner that renders each of the upper rollers 83A rotatable, and is supported swingably relative to the immovable portion 110 of the fixing device case 80. More specifically, each individual holder of the first holder 84 is pivoted on a pivot shaft 112 that is provided on the immovable portion 110 in a position located frontwardly of (i.e., adjacent to an upstream part of the sheet conveyance path 80A with respect to) the upper roller 83A. This allows the first holder 84 to be swung upward and downward on the pivot shaft 112. In this way, each upper roller 83A supported by the corresponding individual holder of the first holder 84 is rendered swingable upward and downward between the position shown in FIG. 3A (corresponding to the first position of the conveyor roller assembly 83) and the position shown in FIG. 3B (corresponding to the second position of the conveyor roller assembly 83) relative to the immovable portion 110 (body casing 2).

Each individual holder of the first holder 84 is pressed down by a torsion spring 87 as one example of a roller pressure element. This in turn causes each upper roller 83A to be pressed to the corresponding lower roller 83B. Each individual holder of the first holder 84 comprises a projection 841 disposed at each sidewall thereof to project outward in an axial direction of the upper roller 83A. The projection 841 is arranged such that its lower end comes in contact with a restricting part 113 provided at the immovable portion 110 when the corresponding upper roller 83A supported by the first holder 84 is positioned as shown in FIG. 3A. In this way, the restricting part 113 operates in cooperation with the projection 841 of the first holder 84 and serves to locate the upper roller 83A in place when the upper roller 83A is shifted to the position shown in FIG. 3A.

In addition, each individual holder of the first holder 84 has sheet guide portions 842 provided at right and left sides of a lower end thereof and the sheet guide portions 842 provide a variable-position guideway extending from a front end (located along the upstream part of the sheet conveyance path 80A) toward a peripheral surface of the corresponding upper roller 83A. Each sheet guide portion 842 is configured to protrude from the corresponding guide rib 111 when the upper roller 83A is in the lower position as shown in FIG. 3A, so that the sheet guide portion 842 alone guides the conveyance of a sheet P (see an arrow in FIG. 3A) toward a nip position at which the upper roller 83A and the lower roller 83B nip the sheet P. On the other hand, when the upper roller 83A is in the upper position as shown in FIG. 3B, the sheet guide portion 842 is aligned with the guide rib 111 as viewed from the axial direction of the upper roller 83A, so that the both of the sheet guide portion 842 and the guide rib 111 serve to guide the conveyance of the sheet P (see an arrow in FIG. 3B) toward the nip position of the upper and lower rollers 83A, 83B.

Figure 4:
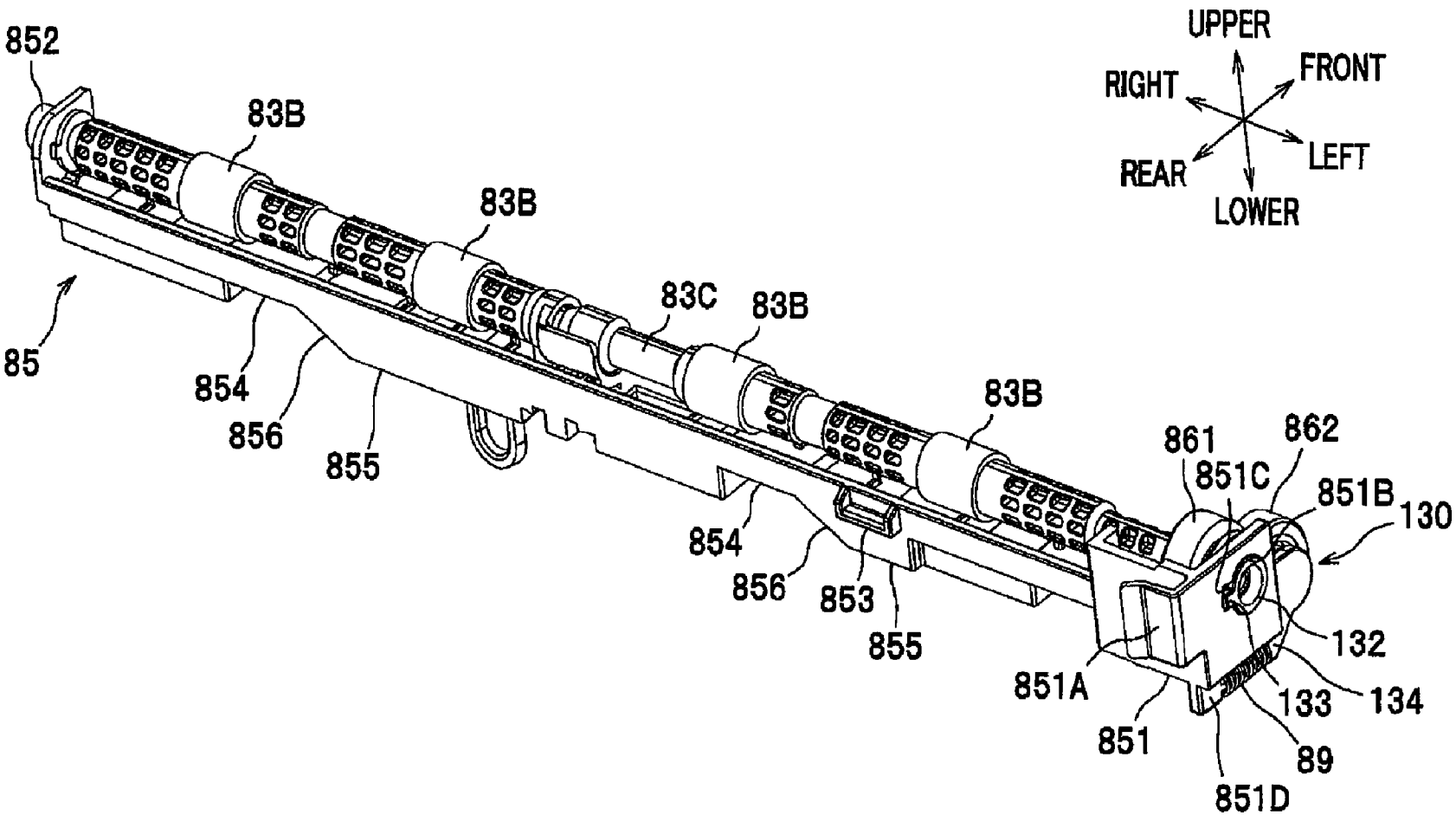
FIG. 4 is a perspective view of an assembly of a lower roller and a second holder.

As shown in FIGS. 4 and 5, the second holder 85 is configured to support the lower rollers 83B (the others of the paired conveyor rollers) in a manner that renders the lower rollers 83B rotatable, and is supported slidably along the swingable portion 120 of the fixing device case 80. More specifically, the second holder 85 comprises a gear cover 851 disposed at a left end thereof and a projecting end portion 852 disposed at a right end thereof. The gear cover 851 has a hook portion 851A slidably engaged with the swingable portion 120, and the projecting end portion 852 is engaged in an oblong hole 123 (see FIG. 2) provided in the swingable portion 120, so that the second holder 85 is rendered slidable upward and downward.

Accordingly, the lower rollers 83B supported by the second holder 85 are also rendered slidable along the swingable portion 120 upward and downward between the position shown in FIG. 3A and the position shown in FIG. 3B. The lower rollers 83B are connected by a roller shaft 83C extending transversely, and are thus configured to rotate together by the driving force transmitted from the gear mechanism 86 that will be described later.

The second holder 85 comprises an operation knob 853 projecting rearward from a rear surface of the second holder 85 on the left side thereof.

The conveyor roller assembly 83 (conveyor rollers 83A, 83B) is configured to be shiftable between a position (first position) shown in FIG. 5A and a position (second position) shown in FIG. 5B so as to be located in place relative to the body casing 2. In order to shift the conveyor roller assembly 83 between the first position and the second position, the operation knob 853 is manipulated, and moved upward or downward, through an opening formed when the rear cover 24 (see FIG. 1) is opened.

The second holder 85 comprises a rear wall having two first support surfaces 854 and two second support surfaces 855 provided at a lower side thereof, and the vertical position (or height) of the first support surfaces 854 is different from that of the second support surfaces 855. Each one of the first support surfaces 854 and the next second support surface 855 disposed to the left thereof are continuously connected by a sloped surface 856 extending downward from the left end of the first support surface 854 to the right end of the second support surface 855.

The first support surfaces 854 are surfaces supported from below by a position retaining member 88 when the lower rollers 83B (second holder 85) are in the lower position (corresponding to the first position of the conveyor roller assembly 83).

The second support surfaces 855 are surfaces supported from below by the position retaining member 88 when the lower rollers 83B (second holder 85) are in the upper position (corresponding to the second position of the conveyor roller assembly 83). The second support surfaces 855 are lower than the first support surfaces 854.

Structure for locating the conveyor roller assembly 83 in place and operation for shifting the conveyor roller assembly 83 are described below.

At a rear side of the swingable portion 120, a plate-like position retaining member 88 is provided as shown in FIGS. 5A and 5B. The position retaining member 88 is disposed on the same plane extending in a direction perpendicular to the front-rear direction as that in which the operation knob 853 is disposed.

Since the position retaining member 88 has laterally extending oblong holes 88A each engaged with a projection 124 provided at the rear side of the swingable portion 120, the position retaining member 88 can be slid only laterally in an axial direction of the conveyor roller 83B relative to the swingable portion 120 in a limited stroke. When the second holder 85 is in the lower position (corresponding to the first position of the conveyor roller assembly 83), the position retaining member 88 is aligned with the operation knob 853 in the axial direction of the conveyor roller 83B. Therefore, the operation knob 853 serves as a stopper to restrict the sliding movement of the position retaining member 88 to the right in the axial direction of the conveyor roller 83B.

The position retaining member 88 also has substantially trapezoidal supporting blocks 88B protrusively disposed at a front side (surface behind in FIG. 5) of the position retaining member 88. Either of the first support surface 854 or the second supporting surface 855 of the second holder 85 is arranged to abut on each supporting block 88B from above, so that the position retaining member 88 thus supports the second holder 85 in one of the upper and lower positions from below.

When the conveyor roller assembly 83 is to be shifted upward (from the position shown in FIG. 5A to the position shown in FIG. 5B), first, the operation knob 853 is lifted up to slide the second holder 85 upward, to move the lower rollers 83B upward. In this operation, the upper rollers 83A are pushed up by the lower rollers 83B, and swung upward. In this way, the conveyor roller assembly 83 (pairs of conveyor rollers 83A, 83B) can be shifted to the upper position (second position). Thereafter, the position retaining member 88 is slid toward the right-hand side of FIG. 5B, whereby the second holder 85 (the second support surfaces 855 thereof) is supported by the supporting blocks 88B from below. As a result, the conveyor roller assembly 83 is retained in the second position, as shown in FIG. 5B.

When the conveyor roller assembly 83 is to be shifted downward (from the position shown in FIG. 5B to the position shown in FIG. 5A), the position retaining member 88 is slid toward the left-hand side of FIG. 5B. By doing so, the second holder 85 is slid downward with each sloped surface 856 thereof being slid along an opposed sloped surface (not marked with reference character) of the corresponding supporting block 88B of the position retaining member 88, and the lower rollers 83B are also moved downward accordingly. Since the first holders 84 are swung downward with the help of the action (pressing force) of the torsion spring 87, the upper rollers 83A are swung downward as well. In this way, the conveyor roller assembly 83 can be shifted to the lower position (first position). When the conveyor roller assembly 83 is in the first position, the position retaining member 88 supports the second holder (first support surfaces 854 thereof) from below by means of the supporting blocks 88B, and is aligned with the operation knob 853 in the axial direction of the conveyor rollers 83B, as shown in FIG. 5A.

Figure 6:
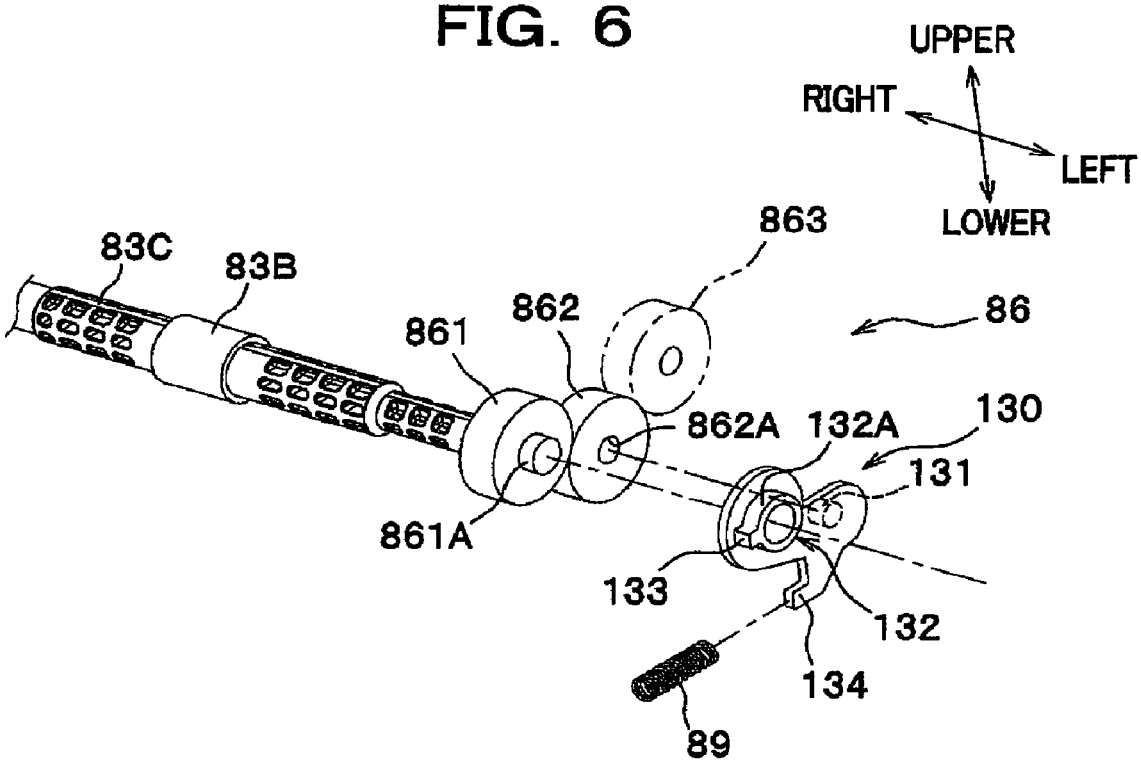
FIG. 6 is an exploded perspective view of a gear mechanism.

As shown in FIGS. 6, 7A and 7B, the gear mechanism 86 principally includes a conveyor roller gear 861, an intermediate gear 862, a driving gear 863, and a gear holder 130 as one example of a gear holding member.

The conveyor roller gear 861 is fixed to a left end of the lower roller 83B (a roller shaft 83C thereof), and configured to rotate integrally with the lower roller 83B. This conveyor roller gear 861 is supported through the roller shaft 83C by the second holder 85, and is thus allowed to be moved upward and downward rectilinearly (in a straight line when viewed from the axial direction of the lower gear 83B) between the position shown in FIG. 7A (corresponding to the first position of the conveyor roller assembly 83) and the position shown in FIG. 7B (corresponding to the second position of the conveyor roller assembly 83).

The intermediate gear 862 is arranged to mesh with the conveyor roller gear 861 and the driving gear 863 so as to transmit power between the conveyor roller gear 861 and the driving gear 863 so that a rotatory driving force can be transmitted from the driving gear 863 to the conveyor roller gear 861. Operation of the intermediate gear 862 will be described later.

The driving gear 863 is rotatably supported by the immovable portion 110 (the body of the apparatus), and is arranged to mesh with the intermediate gear 862 and the heating roller gear 811 configured to rotate integrally with the heating roller 81 (see FIG. 1). This driving gear 863 is configured to receive a rotatory driving force. The rotatory driving force is generated by a power source (not shown) provided in the body casing 2 and transmitted through a transmission gear (not shown) and the heating roller gear 811 to the driving gear 863. The rotatory driving force thus transmitted to the driving gear 863 is then transmitted through the intermediate gear 862 to the conveyor roller gear 861, causing the lower roller 83B to rotate, so as to drive the conveyor roller assembly 83.

The gear holder 130 holds the conveyor roller gear 861 and the intermediate gear 862 in such a manner that a distance between axes of the conveyor roller gear 861 and the intermediate gear 862 remains unchanged. To be more specific, the gear holder 130 includes a cylindrical part 132 and a shaft 131. A shaft 861A of the conveyor roller gear 861 is disposed inside the cylindrical part 132 of which a detailed description will be given later so that the conveyor roller gear 861 is rotatably held by the gear holder 130. The shaft 131 protruding from a right side of the gear holder 130 is disposed inside a recess 862A which is provided in the intermediate gear 862 and a center of which is coincident with an axis of rotation of the intermediate gear 862 so that the intermediate gear 862 is rotatably held by the gear holder 130. Furthermore, the gear holder 130 holds the intermediate gear 862 in such a manner that the intermediate gear 862 can swing around an axis of rotation of the conveyor roller gear 861.

The cylindrical part 132 of the gear holder 130 is shaped like a hollow cylinder extending coaxially with the shaft 861A of the conveyor roller gear 861 and laterally from a left side of the gear holder 130 outward. A protrusion 133 extending in a radial direction of the cylindrical part 132 is formed at an outer peripheral surface 132A of the cylindrical part 132.

When the lower rollers 83B connected by the roller shaft 83C are supported by the second holder 85 with the gear mechanism 86 (conveyor roller gear 861 and intermediate gear 862) being held by the gear holder 130 as shown in FIG. 4, a rear portion of the gear holder 130 and the conveyor roller gear 861 are covered by a gear cover 851 provided in the second holder 85. The cylindrical part 132 of the gear holder 130 is supported inside the round hole 851B provided in the gear cover 851. An arcuate recess 851C shaped like a fan engageable with the protrusion 133 is formed at an inner peripheral surface of the hole 851B. As shown in FIGS. 7A and 7B, the vertical dimension of the arcuated recess 851C is greater than the vertical dimension of the protrusion 133, so that the protrusion 133 is allowed to shift (swing) in a circumferential direction of the cylindrical part 132.

The gear holder 130 has a spring mount portion 134 projecting downward from a lower end thereof. The second holder 85 has a spring mount portion 851D provided at a lower end of the gear cover 851. The spring mount portion 851D and the spring mount portion 134 are aligned in the front-rear direction, and disposed opposite to each other. A coil spring 89 as one example of a gear pressure element is disposed between the opposed spring mount portions 134 and 851D. The coil spring 89 is configured to press the gear holder 130 to thereby press the intermediate gear 862 to the driving gear 863 which is not held by the gear holder 130.

With the gear mechanism 86 configured as described above, when the conveyor roller assembly 83 (the lower roller 83B disposed coaxially with and fixed to the conveyor roller gear 861) is shifted from the position shown in FIG. 3A to the position shown in FIG. 3B, the conveyor roller gear 861 is moved together with the lower roller 83B rectilinearly upward from the position shown in FIG. 7A to the position shown in FIG. 7B. During this operation, the intermediate gear 862 is pushed down by the driving gear 863 and is swung clockwise relative to the conveyor roller gear 861 (around the shaft 861A); however, the intermediate gear 862 remains in constant mesh with the driving gear 863 by the action of the coil spring 89 pressing the intermediate gear 862 to the driving gear 863.

On the other hand, when the conveyor roller assembly 83 (the lower roller 83B) is shifted from the position shown in FIG. 3B to the position shown in FIG. 3A, the conveyor roller gear 861 is moved together with the lower roller 83B rectilinearly downward from the position shown in FIG. 7B to the position shown in FIG. 7A. During this operation, the intermediate gear 862 is swung counterclockwise relative to the conveyor roller gear 861 (around the shaft 861A), and is pressed against the driving gear 863 by the action of the coil spring 89; therefore, the intermediate gear 862 remains in constant mesh with the driving gear 863.

The conveyor roller gear 861 and the intermediate gear 862 are kept in constant mesh with each other by the gear holder 130 that holds the gears 861 and 862 in such a manner that a distance between axes of the gears 861 and 862 remains unchanged.

As described above, even when the conveyor roller gear 861 is shifted, the intermediate gear 862 remains in constant mesh with the conveyor roller gear 861 and the driving gear 863 so that a rotatory driving force can always be transmitted between the conveyor roller gear 861 and the driving gear 863. Therefore, the rotatory driving force can reliably be transmitted from the driving gear 863 to the conveyor roller gear 861

Figure 8:
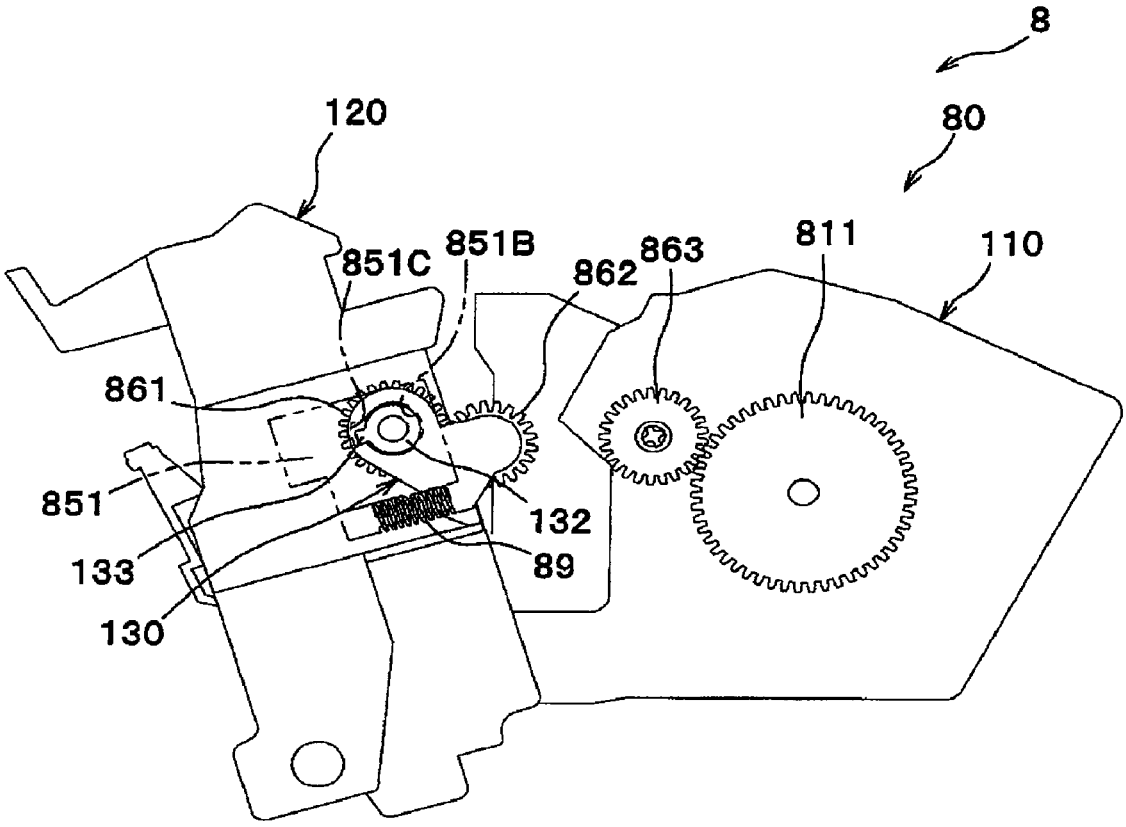
FIG. 8 is a schematic diagram showing how the swingable portion is swung open from the immovable portion.

In the present embodiment, the conveyor roller gear 861 and the intermediate gear 862 are supported through the gear holder 130 and the second holder 85 by the swingable portion 120 of the fixing device case 80. Accordingly, the intermediate gear 862 and the driving gear 863 are moved out of engagement as shown in FIG. 8 when the swingable portion 120 is swung open to expose the sheet conveyance path 80A (see FIG. 3A).

When the swingable portion 120 is swung open, the motion of the intermediate gear 862 in the counterclockwise direction caused by the coil spring 89 is restricted to a predetermined position by the protrusion 133 of the gear holder 130 which comes in contact with one end of the recess 851C of the second holder 85. On the other hand, the motion of the upper roller 83A in the downward direction is restricted to a predetermined position by the projection 841 of the first holder 84 which comes in contact with the restricting part 113 (see FIG. 3A). With this configuration, when the swingable portion 120 is swung to a closed position, the intermediate gear 862 and the driving gear 863 can be brought into engagement with each other smoothly and completely, and the upper roller 83A and the lower roller 83B can be brought into a position appropriate to nip a recording sheet.

According to the present embodiment as described above, the following advantageous effects may be expected.

Since the first holder 84 includes the sheet guide portions 842 which provide a variable-position guideway extending from a position located upstream along the sheet conveyance path 80A toward the peripheral surfaces of the upper rollers 83A and which are configured to protrude from the guide ribs 111 when the upper rollers 83A are in the lower position (corresponding to the first position of the conveyor roller assembly 83), a sheet P is guided along the sheet guide portions 842 when the conveyor roller assembly 83 is in the lower position, and thus can be conveyed smoothly to a nip position at which the upper and lower rollers 83A and 83B nip the sheet P.

On the other hand, when the conveyor roller assembly 83 is in the upper position (second position), a sheet P is guided along the guide ribs 111 (and the sheet guide portions 842), and thus can be conveyed smoothly to a nip position at which the upper and lower rollers 83A and 83B nip the sheet P.

Consequently, in a laser printer having a conveyor roller assembly 83 (upper and lower rollers 83A, 83B) shiftable relative to the body casing 2 between a first position and a second position, a sheet P can always be conveyed smoothly toward a nip position of the conveyor roller assembly 83 located in any position between the first and second positions, with the help of the sheet guide portions 842 configured to come to a position suitable to guide the sheet P toward the nip position which shifts according as the conveyor roller assembly 83 is shifted. Furthermore, on account of this, the possibility of jamming of sheet P which could otherwise result from collision of the sheet P against one of the rollers 83A, 83B or the guide ribs 111 or the like can be reduced or excluded.

Since the pair of conveyor rollers 83A, 83B comprises a plurality of pairs of rollers arranged along a width of the sheet P and the first holder 84 comprises a plurality of individual holders each provided for a corresponding pair of conveyor rollers 83A, 83B (each of the upper rollers 83A) in the conveyor roller assembly 83, each of the upper rollers 83A can be independently swung where appropriate in accordance with the thickness of the sheet P as conveyed and any partial unevenness on the surface of the sheet P. Accordingly, the sheet P can be conveyed more smoothly and more reliably.

Since the torsion spring 87 configured to press the upper roller 83A supported by the first holder 84 to the lower roller 83B, the upper and lower rollers 83A, 83B can be kept in contact with each other with an appropriate range of pressure even when the conveyor roller assembly 83 is shifted. Accordingly, the sheet P can be conveyed reliably.

Since the first holder 84 comprises the projection 841 disposed to project outward in an axial direction of the upper roller 83A and the immovable portion 110 (the body of the apparatus) comprises the restricting part 113 configured to come in contact with the projection 841 to locate the upper roller 83A in place when the conveyor roller assembly 83 is positioned in the first position, the position of the upper roller 83A can be retained in a predetermined location. Accordingly, the upper roller 83A is prevented from being excessively swung downward, so that for example the upper roller 83A would not be pressed too hard against the lower roller 83B. Moreover, the operation of closing the swingable portion 120 as carried out after any jammed sheet P is removed from the sheet conveyance path 80A can be successfully performed because the upper roller 83A and the lower roller 83B can be located in an adequately nipping position.

Since the second holder 85 supports the lower roller 83B in such a manner that the lower roller 83B can be moved rectilinearly in an upward or downward direction relative to the swingable portion 120, the amount of shift of the lower roller 83B (conveyor roller assembly 83) can be greater in comparison with an alternative arrangement in which the lower roller 83 is rendered swingable around a pivot. Accordingly, reduction in the amount of curl effected by shifting the position of the conveyor roller assembly 83 can be maximized.

Since the second holder 85 comprises the operation knob 853 to be manipulated when the second holder 85 (and the lower roller 83B supported thereby) is moved upward or downward, the operation of shifting the conveyor roller assembly 83 can be performed easily. Moreover, since the position retaining member 88 (supporting blocks 88B) is provided so as to support the second holder 85 from below when the lower roller 83B is in an upper position, the second holder 85 (and the conveyor roller assembly 83) can be supported in a stable and reliable manner.

Furthermore, in order to shift the conveyor roller assembly 83 to the upper position (second position), the operation knob 853 should be manipulated to move the second holder 85 upward, and the position retaining member 88 should then be slid to a position in which the supporting blocks 88B support the second support surfaces 855. Therefore, as long as no manual intervention is made by a user, the conveyor roller assembly 83 is retained in the lower position (first position).

Since the gear holder 130 is configured to hold the conveyor roller gear 861 and the intermediate gear 862 in a manner that allows the intermediate gear 862 to swing around the axis of rotation of the conveyor roller gear 861, and the coil spring 89 is configured to press the intermediate gear 862 to the driving gear 863 which is not held by the gear holder 130, the intermediate gear 862 can always mesh with the conveyor roller gear 861 and the driving gear 863 so that a driving force can be transmitted between the conveyor roller gear 861 and the driving gear 863 even when the conveyor roller assembly 83 (and the conveyor roller gear 861) is shifted. Accordingly, the driving force from the driving gear 863 can be transmitted reliably to the conveyor roller gear 861 (i.e., to the conveyor roller assembly 83).

Since the protrusion 133 is provided at the outer peripheral surface 132A of the cylindrical part 132, and the recess 851C engageable with the protrusion 133 in a manner that permits movement of the protrusion 133 in a circumferential direction of the cylindrical part 132 is provided at the inner peripheral surface of the round hole 851B of the second holder 85, the position of the gear holder 130 (intermediate gear 862) can be restricted in a predetermined location.

With this configuration, the force with which the intermediate gear 864 is pressed to the driving gear 863 may not become greater than is necessary, and thus the gears 861, 862 and 863 are allowed to rotate stably and reliably. Furthermore, the intermediate gear 862 could but not so much be shifted when the swingable portion 120 is swung open (see FIG. 2), so that the intermediate gear 862 and the driving gear 863 can be arranged to neatly mesh with each other when the swingable portion 120 is closed after any jammed sheet P is removed from the sheet conveyance path 80A. Accordingly, the swingable portion can be closed properly and smoothly.

Although one exemplary embodiment of the present invention has been described above, the present invention is not limited to the above-described embodiment. It is to be understood that various modifications and changes may be made to the specific configurations as described above without departing from the scope of the present invention where appropriate.

Figure 9:
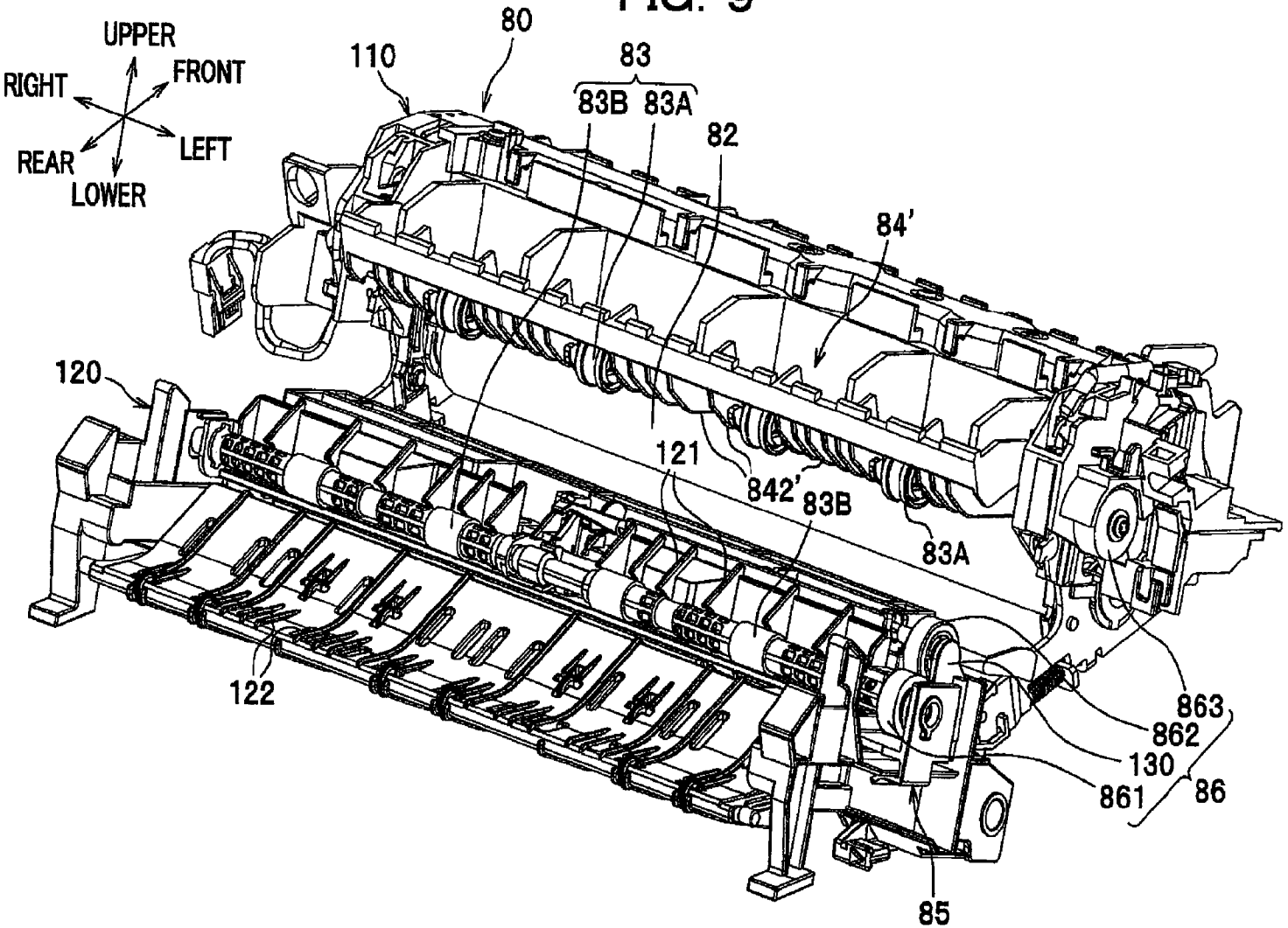
FIG. 9 is a perspective view of the fixing device having a first holder modified according to an exemplary embodiment of the present invention.

In the above-described embodiment, the first holder 84 is illustrated to comprise a plurality of individual holders each provided for a corresponding pair of conveyor rollers 83A, 83B (each of the upper rollers 83A), but the present invention is not limited to this specific configuration. For example, a first holder 84' as shown in FIG. 9 may be used instead. The first holder 84' is a single integral member configured to support every pair of the conveyor rollers in assembly 83 (all of the upper rollers 83A). The first holder 84' is supported in such a manner that the first holder 84' can be swung upward and downward relative to the immovable portion 110, and is pressed downward by a roller pressure element (e.g., a torsion spring or the like), though specific structures are not illustrated in FIG. 9. In this way, each upper roller 83A supported by the first holder 84' is also made swingable upward and downward, and to be pressed to the corresponding lower roller 83B.

With this alternative embodiment, the first holding member configured to support the pair of conveyor rollers consistent with the present invention may be realized by the first holder 84' in the form of a single integral member which can be mounted easily to the immovable portion 110 and which renders the pressing force pressing each upper roller 83A against a corresponding lower roller 83B substantially uniform so that a sheet P can be conveyed stably and reliably.

The first holder 84' includes a plurality of sheet guide portions 842' arranged laterally at a lower end thereof and shaped like ribs which together provide a variable-position guideway extending from the front side toward the peripheral surfaces of the upper rollers 83A. The sheet guide portions 842' configured as described above, in operation, are swung upward or downward together with the upper rollers 83A so as to guide a sheet P toward the nip position at which the upper rollers 83A and the lower rollers 83B nip the sheet P, when the upper rollers 83A are in the upper position as well as when the upper rollers 83A are in the lower position. Alternatively, a plurality of guide ribs may be provided at the immovable portion 110, and the sheet guide portions 842' may be configured to protrude from the guide ribs only or at least when the upper rollers 83A are in the lower position.

In the above-described embodiment, the first holder 84 (first holding member) is pivoted on the pivot shaft 112 that is provided on the immovable portion 110, in such a manner that the first holder 84 can be swung upward and downward on the pivot shaft 112. However, the present invention is not limited to this specific configuration. For example, the first holding member may have a pivot shaft disposed to project outward in the axial direction of the conveyor roller supported by the first holding member, and the pivot shaft may be supported at the body of the apparatus.

In the above-described embodiment, the sheet guide portions 842 are configured to protrude from the guide ribs 111 when the upper rollers 83A (the conveyor roller supported by the first holding member) are in the lower position (first position), but the present invention is not limited to this specific configuration. For example, the sheet guide portion may be configured to also protrude from the guide (guide walls or the like) which defines the sheet conveyance path when the conveyor roller assembly is in the second position. In this configuration, the amount of protrusion of the sheet guide portion located when the conveyor roller assembly is in the first position should be different from that of the sheet guide portion located when the conveyor roller assembly is in the second position.

In the above-described embodiment, the torsion spring 87 is adopted as a roller pressure element, but the present invention is not limited to this specific configuration. For example, a coil spring or a leaf spring may be adopted, instead.

In the above-described embodiment, a plurality of guide ribs 111 are illustrated as one example of the guide fixed to the body of the apparatus and configured to guide the recording sheet toward the nip position of the pair of conveyor rollers when the pair of conveyor rollers is in the second position, but the present invention is not limited to this specific configuration. For example, the guide fixed to the body may include a guide surface (guide wall constituting the sheet conveyance path).

In the above-described embodiment, the first holding member is illustrated, on one hand, as the first holder 84 comprising a plurality of individual holding members each provided for a corresponding upper roller 83A, and on the other hand, as the first holder 84' comprising a single integral member configured to support all the upper rollers 83A. However, the present invention is not limited to these specific configurations. For example, four pairs of conveyor rollers and two first holding members may be provided so that each first holding member may support two pairs of conveyor rollers (two upper rollers).

In the above-described embodiment, a pair of conveyor rollers (conveyor roller assembly 83) is configured to be moved upward and downward between a first position and a second position, but the present invention is not limited to this specific configuration. For example, such a pair of conveyor rollers may be moved frontward and rearward between the first position and the second position. Moreover, in the above-described embodiment, four pairs of conveyor rollers 83A, 83B arranged along a width of a sheet P as conveyed are provided, but the number of the pairs of conveyor rollers to be provided in accordance with the present invention may not be limited to this or any other numbers. Two or more pairs of conveyor rollers may be provided, and merely one pair of conveyor rollers may suffice as the case may be.

The structures and shapes of the first holder 84 and the second holder 85 as illustrated in the aforementioned embodiment are exemplary only, and the present invention is not limited thereto. In other words, the above-described first and second holders 84 and 85 may be modified as appropriate, and the first holding member and the second holding member consistent with the present invention may be differently implemented without departing from the scope of the present invention as long as the first holding member and the second holding member operate in such a manner that the first and second holders 84 and 85 operate.

In the above-described embodiment, the driving gear 863 is configured to receive a rotatory driving force transmitted via another gear (heating roller gear 811), but the present invention is not limited to this specific configuration. For example, the driving gear may be configured to receive a rotatory driving force directly transmitted from a power source provided in the body of the apparatus.

In the above-described embodiment, the coil spring 89 is adopted as a gear pressure element, but the present invention is not limited to this specific configuration. For example, a torsion spring or a leaf spring may be adopted, instead.

In the above-described embodiment, a plurality of guide ribs 121, 122 are illustrated as one example of a portion of the swingable portion 120 (roller holding member) which defines the sheet conveyance path 80A, but the present invention is not limited to this specific configuration. For example, a wall of the swingable portion opposed to the immovable portion 110 may be configured to serve as a portion defining the sheet conveyance path.

The roller holding member is configured according to the present invention to support a conveyor roller that is rotatable integrally with the conveyor roller gear fixed thereto. This, however, does not necessarily mean that the roller holding member should directly support the conveyor roller that is rotatable integrally with the conveyor roller gear fixed thereto. That is, an alternative configuration as in the above-described embodiment may be applicable, and thus fall within the scope of the present invention, such that the roller holding member (swingable portion 120) indirectly supports the conveyor roller (lower roller 83B) that is rotatable integrally with the conveyor roller gear fixed thereto by means of a second holding member (second holder 85) that may be configured to directly support the conveyor roller (lower roller 83B).

In the above-described embodiment, the swingable portion 120 (roller holding member) is configured to be swingable relative to the immovable portion 110 (body of the apparatus) so that the sheet conveyance path 80A (guide ribs 111, 121, 122) is exposed when the swingable portion 120 is swung open, but the present invention is not limited to this specific configuration. That is, the present invention is applicable to any alternative embodiment in which a roller holding member is not configured to be swingable relative to the body of the apparatus.

Figure 10A:
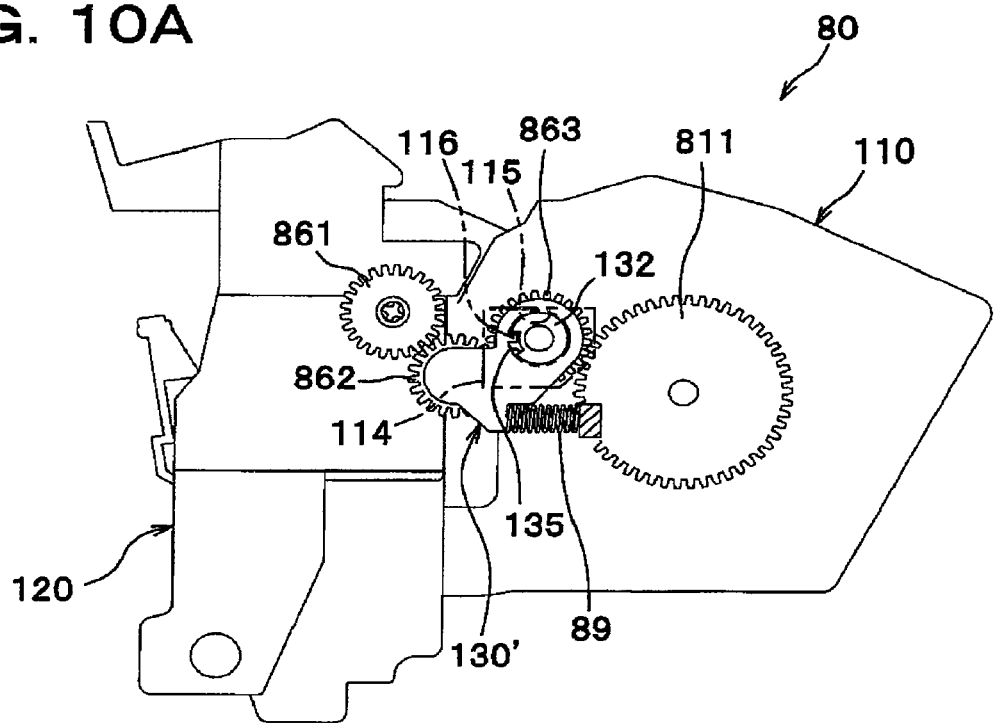
FIG. 10A is a schematic diagram of the fixing device having a gear mechanism modified according to an exemplary embodiment of the present invention.

In the above-described embodiment, it is shown that the gear holder 130 (gear holding member) is configured to hold the conveyor roller gear 861 and the intermediate gear 862 and supported by the swingable portion 120 (roller holding member), while the driving gear 863 is supported by the immovable portion 110 (body of the apparatus), but the present invention is not limited to this specific configuration. For example, an alternative embodiment as shown in FIG. 10A may be practicable in which a gear holder 130' (gear holding member) is configured to hold the driving gear 863 and the intermediate gear 862 and supported by the immovable portion 110 (body of the apparatus), while the conveyor roller gear 861 is supported by the swingable portion 120 (roller holding member). In this configuration, the intermediate gear 862 is configured to be swingable around an axis of rotation of the driving gear 863, and is pressed by the coil spring 89 to the conveyor roller gear 861 which is not held by the gear holder 130'.

Figure 10B:
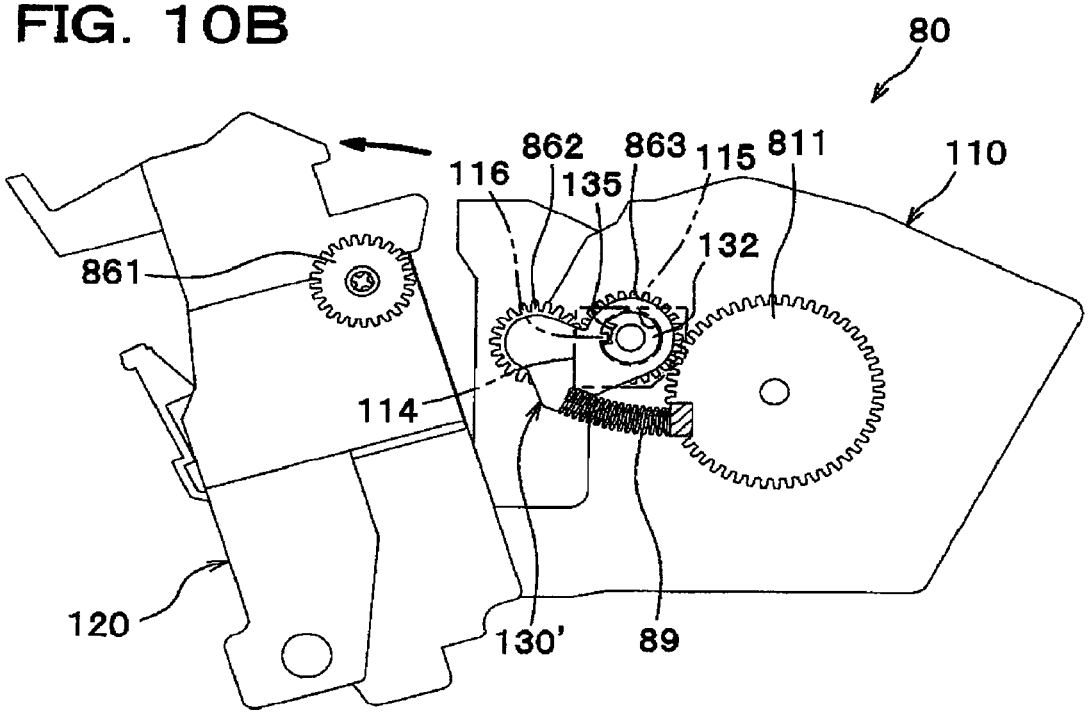
FIG. 10B is a schematic diagram showing how the swingable portion is swung open from the immovable portion.

In this configuration, as shown in FIG. 10B, when the swingable portion 120 is swung open to expose the sheet conveyance path 80A (see FIGS. 3A and 3B), the conveyor roller gear 861 and the intermediate gear 862 are moved out of engagement.

In the above-described embodiment, it is shown that the protrusion 133 is formed at the outer peripheral surface of the cylindrical part 132 provided in the gear holder 130 and the recess 851C is formed at the inner peripheral surface of the round hole 851B provided in the second holder 85, but the present invention is not limited to this specific configuration. For example, an alternative embodiment as shown in FIGS. 10A and 10B may be practicable in which a protrusion 116 extending in a radial direction of the cylindrical part 132 provided in the gear holder 130' is formed at the inner peripheral surface of a round hole 115 provided in the gear cover 114, while a recess 135 that is engageable with the protrusion 116 and configured to permit a relative movement of the protrusion 116 in a circumferential direction of the cylindrical part 132 is formed at the outer peripheral surface of the cylindrical part 132 extending coaxially with an axis of the driving gear 863.

It is to be understood that the structures and shapes of the swingable portion 120 and the gear holder 130 mentioned in describing the above embodiment are illustrated as such by way of example only, and the present invention is not limited thereto. In other words, the above-described swingable portion 120 and gear holder 130 may be modified as appropriate, and the roller holding member and the gear holding member consistent with the present invention may be differently implemented without departing from the scope of the present invention as long as the roller holding member and the gear holding member operate in such a manner that the swingable portion 120 and the gear holder 130 operate.

In the above-described embodiment, the conveyor roller assembly 83 (a pair of conveyor rollers) and the conveyor roller gear 861 are provided in the fixing device 8 of the laser printer 1, but, the present invention is not limited to this specific configuration. For example, the pair of conveyor rollers and the conveyor roller gear may be provided in a position separate from and downstream of the fixing device along the sheet conveyance path. The present invention is not limited to embodiments relating to an apparatus including a conveyor roller assembly specifically designed to convey a recording sheet which has been subjected to a fixing process. It is to be understood that the present invention can be generally applied to any conveyor assembly (comprising a pair of conveyor rollers) configured to be shiftable in position.

In the above-described embodiment, the sheet P is described on the premise that the sheet P is a sheet of paper such as a cardboard, postcard, tracing paper, etc., but a sheet or a recording sheet consistent with the present invention is not limited thereto. For example, an OHP sheet may be used in any conveyor roller assembly or any apparatus embodied in accordance with the present invention.

In the above-described embodiment, the laser printer 1 for forming a single-color image is shown as one example of an image forming apparatus, but the image forming apparatus to which the present invention is applicable is not limited thereto. For example, the image forming apparatus consistent with the present invention may include a photocopier or a multi-function peripheral for forming a single-color image, and a color printer, a color photocopier or a color multi-function peripheral for forming a multi-color image. Furthermore, the apparatuses consistent with the present invention may not be limited to a particular type in which a photoconductor drum 61 (photoconductor) is exposed to a laser beam as described above. Any other type of image forming apparatuses, in which LEDs (light-emitting diodes), EL (electroluminescence) elements or fluorescent substances are used, may be implemented in accordance with the present invention.

What is claimed is:

1. An image forming apparatus configured to transfer a developer image onto a recording sheet and fixed thereon, comprising:

a body;

a pair of conveyor rollers arranged to convey the recording sheet which has been subjected to a fixing process toward outside of the body, the pair of conveyor rollers being configured to be shiftable relative to the body between a first position and a second position;

a conveyor roller gear fixed to one of the conveyor rollers and configured to rotate integrally with the one of the conveyor rollers, the one of the conveyor rollers being supported in a manner that allows the one of the conveyor rollers as well as the conveyor roller gear to be moved rectilinearly when viewed from an axial direction of the one of the conveyor rollers to shift the pair of conveyor rollers between the first position and the second position;

a driving gear configured to receive a rotatory driving force;

an intermediate gear configured to mesh with the conveyor roller gear and the driving gear, to transmit the rotatory driving force received by the driving gear to the conveyor roller gear;

a gear holding member configured to hold the intermediate gear and one of the conveyor roller gear and the driving gear in a manner that allows the intermediate gear to swing around an axis of rotation of the one of the conveyor roller gear and the driving gear; and a gear pressure element configured to press the intermediate gear to the other of the conveyor roller gear and the driving gear which is not held by the gear holding member.

2. The image forming apparatus according to claim 1, further comprising a roller holding member configured to support a conveyor roller that is rotatable integrally with the conveyor roller gear fixed thereto, the roller holding member being configured to constitute a part of a sheet conveyance path along which conveyance of the recording sheet which has been subjected to the fixing process is guided, the roller holding member being swingable relative to the body, the sheet conveyance path being exposed when the roller holding member is swung open;

wherein the gear holding member is supported by the roller holding member and configured to hold the conveyor roller gear and the intermediate gear, while the driving gear is supported by the body, whereby the intermediate gear and the driving gear are moved out of engagement when the roller holding member is swung open to expose the sheet conveyance path.

3. The image forming apparatus according to claim 2, wherein the gear holding member comprises a cylindrical part extending coaxially with an axis of the one of the conveyor roller gear and the driving gear which is held by the gear holding member, the cylindrical part being supported inside a round hole provided in the roller holding member; and wherein a protrusion extending in a radial direction of the cylindrical part is provided at one of an outer peripheral surface of the cylindrical part and an inner peripheral surface of the round hole, while a recess that is engageable with the protrusion and configured to permit a relative movement of the protrusion in a circumferential direction of the cylindrical part is provided at the other of the outer peripheral surface of the cylindrical part and the inner peripheral surface of the round hole.

4. The image forming apparatus according to claim 1, further comprising a roller holding member configured to support a conveyor roller that is rotatable integrally with the conveyor roller gear fixed thereto, the roller holding member being configured to constitute a part of a sheet conveyance path along which conveyance of the recording sheet which has been subjected to the fixing process is guided, the roller holding member being swingable relative to the body, the sheet conveyance path being exposed when the roller holding member is swung open;

wherein the gear holding member is supported by the body and configured to hold the driving gear and the intermediate gear, while the conveyor roller gear is supported by the roller holding member, whereby the conveyor roller gear and the intermediate gear are moved out of engagement when the roller holding member is swung open to expose the sheet conveyance path.

5. The image forming apparatus according to claim 4, wherein the gear holding member comprises a cylindrical part extending coaxially with an axis of the one of the conveyor roller gear and the driving gear which is held by the gear holding member, the cylindrical part being supported inside a round hole provided in the body, and wherein a protrusion extending in a radial direction of the cylindrical part is provided at one of an outer peripheral surface of the cylindrical part and an inner peripheral surface of the round hole, while a recess that is engageable with the protrusion and configured to permit a relative movement of the protrusion in a circumferential direction of the cylindrical part is provided at the other of the outer peripheral surface of the cylindrical part and the inner peripheral surface of the round hole.

6. The image forming apparatus according to claim 1, further comprising:

a roller holding member configured to support a conveyor roller that is rotatable integrally with the conveyor roller gear fixed thereto, the roller holding member being configured to constitute a part of a sheet conveyance path along which conveyance of the recording sheet which has been subjected to the fixing process is guided, the roller holding member being swingable relative to the body, the sheet conveyance path being exposed when the roller holding member is swung open;

a second holding member configured to directly support a conveyor roller that is rotatable integrally with the conveyor roller gear fixed thereto, the second holding member being supported by the roller holding member in such a manner that the second holding member is slidable between an upper position and a lower position along the roller holding member, the second holding member comprising an operation knob to be manipulated when the second holding member is slid upward or downward; and a position retaining member configured to be slidable along the second holding member in an axial direction of the conveyor roller supported by the second holding member, between a position in which the second holding member is supported from below by the position retaining member when the conveyor roller supported by the second holding member is in the upper position and a position in which the position retaining member is aligned with the operation knob in the axial direction of the conveyor roller supported by the second holding member when the conveyor roller supported by the second holding member is in the lower position.

* * * * *

UNITED STATES PATENT AND TRADEMARK OFFICE

CERTIFICATE OF CORRECTION

PATENT NO. : 8,342,523 B2
APPLICATION NO. : 13/249837
DATED : January 1, 2013
INVENTOR(S) : Kei Ishida It is certified that error appears in the above-identified patent and that said Letters Patent is hereby corrected as shown below:

On the Title Page, item (54) and in the Specifications, col. 1, line 1, in the Title:
Please delete "IMAGE FORMING APPARATUS WITH INDERMEDIATE GEAR" and insert
-- IMAGE FORMING APPARATUS --

Signed and Sealed this
Eleventh Day of March, 2014

Michelle K. Lee

Michelle K. Lee
*Deputy Director of the United States Patent and Trademark Office*